US005908024A

United States Patent [19]

Staev

[11] Patent Number: 5,908,024

[45] Date of Patent: Jun. 1, 1999

[54] BREECH BLOCK FOR PNEUMATIC SHOOTING DEVICE

[75] Inventor: Victor S. Staev, Pazardjik, Bulgaria

[73] Assignee: Bulforce Engineering Ltd., Plovdia, Bulgaria

[21] Appl. No.: 08/976,331

[22] Filed: Nov. 21, 1997

[51] Int. Cl.[6] ..... F41B 11/00

[52] U.S. Cl. ..... 124/71; 124/73; 124/75; 124/76; 124/31

[58] Field of Search ..... 124/71, 72, 73, 124/74, 75, 31, 37, 41.1, 51.1, 52, 76

[56] References Cited

U.S. PATENT DOCUMENTS

| | | | |
|---|---|---|---|
| 5,280,778 | 1/1994 | Kotsiopoulos | 124/73 |
| 5,383,442 | 1/1995 | Tippmann | 124/76 |
| 5,494,024 | 2/1996 | Scott | 124/73 |
| 5,497,758 | 3/1996 | Dobbins et al. | 124/73 |
| 5,572,982 | 11/1996 | Williams | 124/74 |
| 5,673,679 | 10/1997 | Walters | 124/53.5 |
| 5,769,066 | 6/1998 | Schneider | 124/75 |
| 5,778,868 | 7/1998 | Shepherd | 124/76 |

FOREIGN PATENT DOCUMENTS 1725064 4/1992 U.S.S.R. .

*Primary Examiner*—J. Woodrow Eldred
*Attorney, Agent, or Firm*—McAulay Nissen Goldberg Kiel & Hand, LLP

[57] ABSTRACT

The breech block for pneumatic shooting device is utilized in weapons for expelling solid-state bodies or marking pellets. It has a simplified and easy for maintenance construction ensuring long term exploitation and minimum fluid consumption for one shot. The breech block comprises a housing 1 in which a barrel 2 is mounted. A step-shaped cylindrical bore is formed in the housing 1, and a piston 4 having two parts 9 and 10 of different diameters is placed in the bore. The step-shaped bore in the housing 1 has a portion 13 which diameter is greater than the diameter of the rear part 10 of the piston 4. The piston 4 is provided with an axial passage 14, the rear end of which being connected to radial openings 8 formed at the rear part 10 of the piston 4.

8 Claims, 2 Drawing Sheets

BREECH BLOCK FOR PNEUMATIC SHOOTING DEVICE

TECHNICAL FIELD OF THE INVENTION

The present invention relates to a breech block for pneumatic shooting device utilized in weapons for expelling solid-state bodies or marking pellets by means of compressed fluid.

BACKGROUND OF THE INVENTION

Different constructions of breech block are known which are to be incorporated in pneumatic devices. One such known device for expelling spherical pellets, as described in Author's Certificate No. 1 725 064 A1-SU, comprises a housing having cylindrical bore, in which a step-formed piston is placed. The rear part of said piston is wider, and the diameter of its front part is equal to the diameter of the barrel. A spring placed onto the barrel presses the piston to the rear end of the cylinder. The operation of said breech block is the follows: when supplying a certain portion of carbon dioxide (CO2) from a reservoir of compressed fluid, said fluid acts on the piston pushing it towards for compressing the spring. During that movement the piston clamps a spherical pellet from the magazine and keeps on its movement until its rear part passes through a bore formed in the cylinder where part of the gases is discharged. These gases are discharged through a specially designed for that purpose pipeline or opening in the housing, said opening being located before the front end the piston, whose diameter is smaller. The spherical pellets are expelled through an outlet in the barrel. After the shot the piston is pushed back to its initial position because of the action of the spring.

The pneumatic device described above has a complicated for manufacturing construction including elaboration of a system of channels providing a by-pass connection. Besides, the device has a significant fluid consumption for shooting away of a single pellet because of the long stroke of the piston. Other drawback is that the pressure of the fluid decreases because of the presence of said by-pass connection in the barrel.

Therefore it is object of the present invention to provide a breech block for a pneumatic weapon which has a simplified construction and more effective operation in long-term usage with minimum fluid consumption for one shot.

SUMMARY OF THE INVENTION

The above stated object of the invention is achieved by providing a breech block for pneumatic devices which can shoot away spherical pellets by means of a compressed fluid.

The breech block comprises a housing connected with a barrel, said housing having a cylindrical bore, in which a step-formed piston is placed. The front part of the piston has a diameter equal to the diameter of the barrel. A spring is provided in the bore, the rear end of the spring urging the piston to the base of the bore in the housing. According to the invention the cylindrical bore in the housing has three portions, the first one having diameter equal to the diameter of the barrel, the second one having a diameter equal to the diameter of the rear part of the piston and the third portion of the bore having diameter greater than the diameter of the rear part of the piston. The spring is positioned in the second portion of the bore urging the face of the rear part of the piston, the piston being provided with an axial passage, the rear end of which is connected to a plurality of radial openings formed in the rear part of the piston.

The proposed construction-subject-matter of the invention has more effective operation of the breech block ensuring trouble-free manipulation with minimum fluid consumption. The construction comprises simple and easy for maintenance elements in long term exploitation.

BRIEF DESCRIPTION OF THE DRAWINGS

Further in the description an embodiment of the invention will be described by way of example with reference to the accompanying drawings, in which.

EXAMPLARY EMBODIMENT OF THE INVENTION

Figure 1:
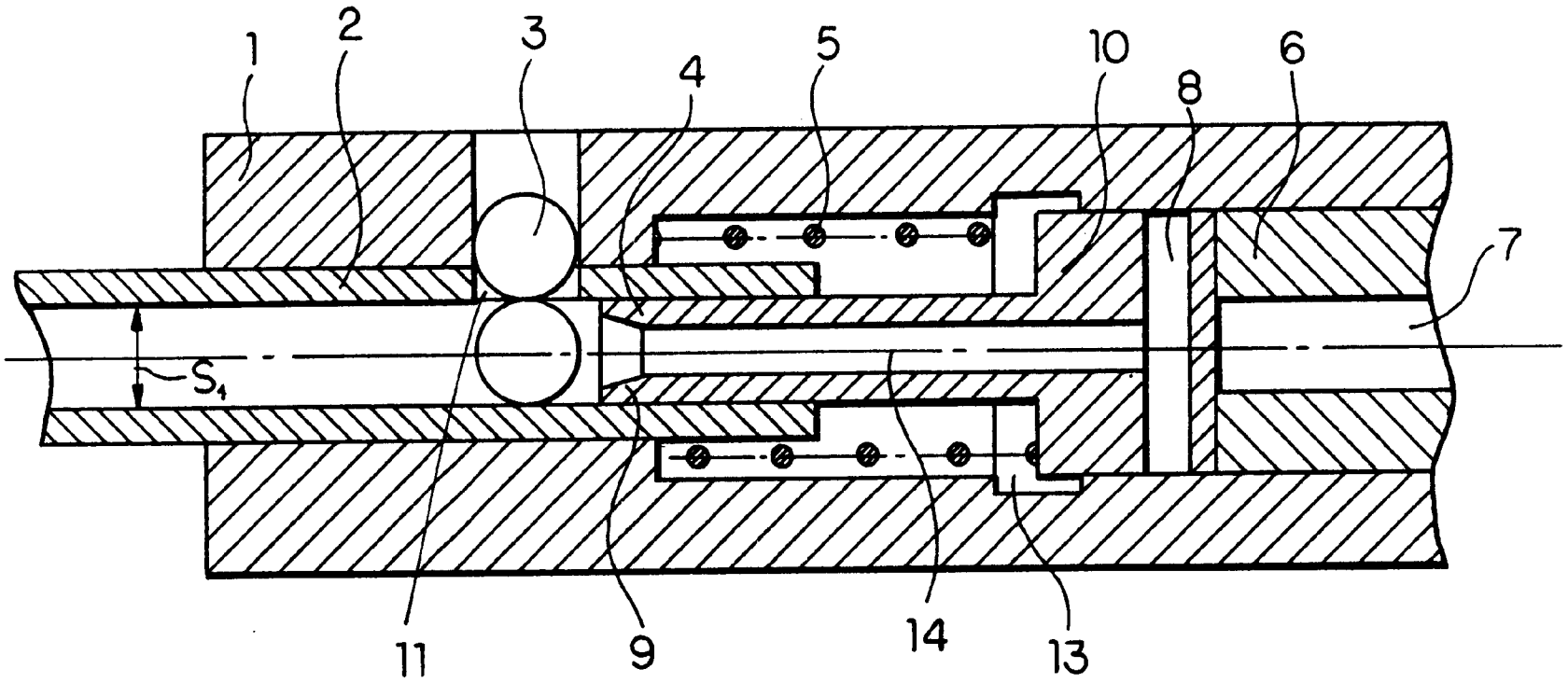
FIG. 1 is a longitudinal section of a breech block for pneumatic device with piston in rear end position.
Figure 2:
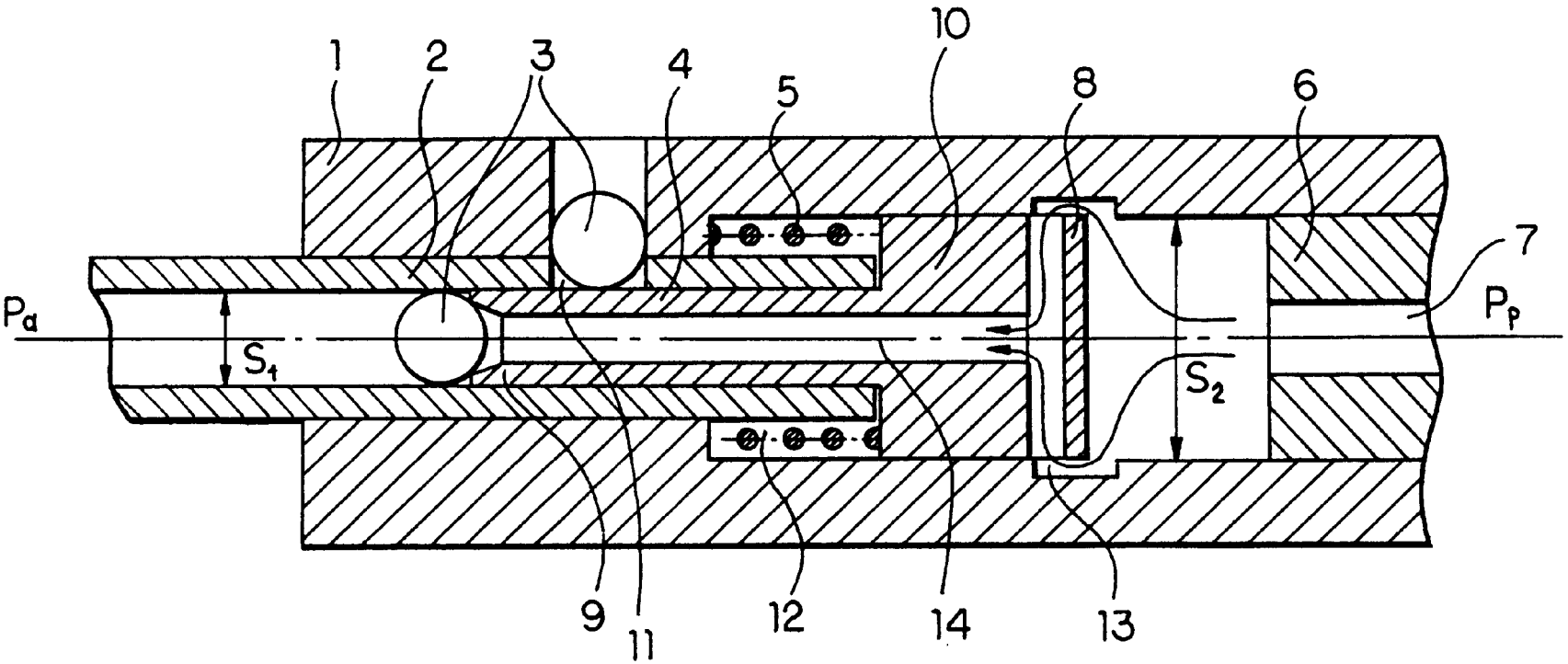
FIG. 2 is a longitudinal section of a breech block with a piston in shooting position.

An exemplary embodiment of the breech block for a pneumatic device for shooting away spherical pellets comprises a housing 1, in which a barrel 2 is mounted connected to a magazine for spherical pellets 3. A step-shaped cylindrical bore is formed in the housing 1, and a piston 4 having two parts 9 and 10 of different diameters is placed in the bore. The diameter of the front part 9 is equal to the diameter of the barrel 2. A spring 5 is put on the piston 4 and the barrel 2, the front end of the spring 5 urges the bottom of the housing 1, and the rear end of the spring 5 urges the face of the rear part 10 of the piston 4 pressing it to a plug 6. The plug 6 is connected via passage 7 to a valve and a reservoir of compressed fluid, not shown in the Figure. The cylindrical bore in the housing 1 has three portions, the first one 11 having diameter equal to the diameter of the barrel 2, the second one 12 having diameter equal to the diameter of the rear part 10 of the piston 4 and the third portion 13 having diameter greater than the diameter of the rear part 10 of the piston 4. The piston 4 is provided with an axial passage 14, the rear end of which being connected to radial openings 8 formed at the rear part 10 of the piston 4.

OPERATION OF THE DEVICE

The pneumatic device for shooting pellets operates as follows: when actuating the trigger mechanism a certain portion of compressed fluid from the reservoir is supplied through the opening 7. As a result the piston 4 moves forward compressing the spring 5. After a stroke of the piston 4 a little bit longer than the diameter of the pellet to be shot the front part 9 of the piston 4 contacts the barrel 2, and the rear part 10 of the piston 4 is positioned within the third portion 13 of the bore which diameter is greater than the diameter of the rear part 10 of the piston 4. As a result of that the gases pass through the radial openings 8 and the axial passage 14 in the piston 4 pushing out the pellet in the barrel 2 and imparting him to them a corresponding velocity. After reduction of the pressure in the barrel 2 the piston 4 moves back to its initial position because of the action of the spring 5, the next pellet 8 from the magazine enters into the barrel 2, and the device is ready for a new shot.

I claim:

1. A breech block for a pneumatic device for shooting away spherical pellets comprising:

a housing (1) connected with a barrel (2) having an inner diameter, said housing having a cylindrical bore provided with a base for receiving a piston (4), said piston including a front part having a diameter equal to the inner diameter of the barrel;

a spring (5) having a front end and a rear end provided in said cylindrical bore, the rear end of the spring including means urging the piston towards the base of said bore in said housing;

said bore being a step-shaped bore and including a first portion (11), a second portion (12) and a third portion (13), said first portion (11) having a diameter equal to the outer diameter of said barrel (2), said second portion (12) having a diameter equal to the diameter of a rear part (10) of the piston (4) and said third portion (13) having a diameter greater than the diameter of the rear part (10) of the piston (4);

said spring (5) being positioned in the second portion (12) of the bore for urging a face of the rear part (10) of the piston (4); and said piston (4) having in a rear part thereof a plurality of radial openings (8) and being provided with an axial passage (14) having a rear end connected to said plurality of radial openings (8) formed in the rear part (10) of the piston (4).

2. The breech block as claimed in claim 1, including a magazine for said spherical pellets connected with said barrel.

3. The breech block as claimed in claim 1, wherein said piston has a first part (9) and a second part forming said rear part (10), the diameters of said first and said second parts being different from each other.

4. The breech block as claimed in claim 1, wherein said spring (5) includes means at a front end thereof for urging the bottom of said housing (1).

5. The breech block as claimed in claim 1, including a plug (6) and a passage (7), said plug being connected by means of said passage to a valve and reservoir.

6. The breech block as claimed in claim 2, wherein said piston has a first part (9) and a second part forming said rear part (10), the diameters of said first and said second parts being different from each other.

7. The breech block as claimed in claim 2, wherein said spring (5) includes means at a front end thereof for urging the bottom of said housing (1).

8. The breech block as claimed in claim 3, wherein said spring (5) includes means at a front end thereof for urging the bottom of said housing (1).

* * * * *